US006789368B2

(12) United States Patent
Savenok

(10) Patent No.: US 6,789,368 B2
(45) Date of Patent: Sep. 14, 2004

(54) STRUCTURAL COLUMN AND METHOD OF COLUMN ASSEMBLY FOR USE IN COMBINATION WITH A BUILDING STRUCTURE

(76) Inventor: Peter Savenok, 1877 S. Orchard Rd., Wheaton, IL (US) 60187

( * ) Notice: Subject to any disclaimer, the term of this patent is extended or adjusted under 35 U.S.C. 154(b) by 0 days.

(21) Appl. No.: 10/318,945

(22) Filed: Dec. 13, 2002

(65) Prior Publication Data

US 2004/0112003 A1 Jun. 17, 2004

(51) Int. Cl.[7] ..... E04C 3/34
(52) U.S. Cl. ..... 52/723.1; 52/721.1; 52/726.3
(58) Field of Search ..... 52/220.1, 300, 52/301, 721.2, 722.1, 723.1, 726.4, 737.1, 737.4, 723.2, 726.3, 730.4, 731.2, 732.3, 736.1, 583.1, 726.1, 726.5

(56) References Cited

U.S. PATENT DOCUMENTS 973,615 A * 10/1910 Barrick ..... 52/292
1,742,223 A * 1/1930 Sears ..... 52/726.3
1,743,439 A * 1/1930 De Witt ..... 285/420
3,670,060 A * 6/1972 Cuffaro et al. ..... 264/77
3,742,985 A * 7/1973 Rubenstein ..... 138/141
4,641,467 A * 2/1987 Dupuis, Jr. ..... 52/297
5,687,537 A * 11/1997 Noble ..... 52/726.3

* cited by examiner

*Primary Examiner*—Anita King
*Assistant Examiner*—Jon Szumny
(74) *Attorney, Agent, or Firm*—Meroni & Meroni P.C.; Charles F Meroni, Jr.; Christopher J. Scott

(57) ABSTRACT

The present invention provides an improved column structure for use with a building structure. The column structure comprises a hollow load-bearing capital, which is mounted on top of a hollow load-bearing column. Both the capital and the column are constructed from polystone. The column structure further comprises a series of brackets for attaching or mounting the capital to the column, which brackets are preferably placed in substantially uniformly spaced distance around a circumference of contact between the capital and the column. The column and the capital together define a passageway wherein the brackets are located. The brackets are paired off, each bracket pairing comprising a capital bracket and a corresponding column bracket, which capital brackets and column brackets are then fastened together.

27 Claims, 3 Drawing Sheets

STRUCTURAL COLUMN AND METHOD OF COLUMN ASSEMBLY FOR USE IN COMBINATION WITH A BUILDING STRUCTURE

BACKGROUND OF THE INVENTION

1. Field of the Invention

The present invention generally relates to improved column construction and method of column construction. More particularly, the present invention relates to improved column and capital construction and method of column and capital construction for use with various building structures.

2. Description of the Prior Art

In the art of structural columns and capital construction prior to the present invention, capitals and columns were joined by placing a load-bearing post inside the hollow cavity of the column and then the capital and column attached to the post. In the prior art, the post was load-bearing rather than the column and capital. In addition, the posts were usually made of wood and thus did not have a heavy load-bearing capacity. Also, in the prior art, the post was situated within the center of the column, which effectively prevented the running of utility conduits and the like through the column and capital.

What is needed then is a means to increase the load-bearing capacity of the columns while allowing for a hollow column and capital combination where a central area is free of load-bearing posts.

The state of materials art is such that polyester resins when mixed with ground limestone in a ratio of approximately 25% resin to 75% limestone creates a material suitable for construction of a hollow load-bearing column and a hollow load-bearing capital. Such materials in use are called polystone. Polystone columns have a far greater load-bearing capacity than wooden posts and have a longer life span than wooden posts. A hollow load-bearing column with a hollow load-bearing capital made of polystone has a load-bearing capacity of up to 20,000 pounds with a safety factor of 10.

Accordingly, it is a principal object of the present invention to provide for the construction of a hollow load-bearing column with an increased load-bearing capacity.

It is a further object of the present invention to provide a column and capital combination, which is easier to assemble.

It is still a further object of the present invention to provide a column and capital combination having an increased lifespan.

It is a further object of the present invention to provide a column and capital combination constructed and shaped with a hollow center through the column and capital combination to enable a utility conduit to be run therethrough.

It is a still further object of the present invention to provide for a column and capital combination which allows for pipe for utilities or plumbing to be run from the roof of the building structure through the hollow center of the column and capital combination.

Yet another object of the present invention is to provide a new attachment system for securing a capital and a column in unitary assembly together for installation with a building as a single unit by a crane.

Other objects of the present invention, as well as particular features, elements, and advantages thereof, will be elucidated in, or apparent from, the following description and the accompanying drawing figures.

SUMMARY OF THE INVENTION

To achieve these and other readily apparent objectives, the present invention provides an improved structural column and capital construction for use in combination with building structures. In this regard, it is noted that building structures having a building entranceway with an entranceway ceiling overhang and an entranceway floor typically further comprise a series of column structures for supporting the overhang, which column structures are structurally located intermediate the entranceway ceiling overhang and the entranceway floor. In other words, the entranceway ceiling overhang may typically be supported by utilizing a series of column structures.

The present invention thus provides an improved column structure for use with the building structures of the described general type. The column structure comprises a hollow load-bearing capital, which is mounted on top of a hollow load-bearing column. Both the hollow load-bearing capital and the hollow load-bearing column comprise or are constructed from polystone. The hollow load-bearing column and the hollow load-bearing capital together define a passageway, which may be used for concealing conduit of various types. The column structure further comprises means for attaching or mounting the hollow load-bearing capital to the hollow load-bearing column. The means for attaching or mounting the hollow load-bearing capital to the hollow load-bearing column comprises a series of sets of brackets, which sets of brackets are preferably placed in substantially uniformly spaced distance around a circumference of contact between the hollow load-bearing capital and the hollow load-bearing column.

The brackets are preferably paired off, each bracket pairing comprising a capital bracket and a corresponding column bracket. Each capital bracket comprises a first capital bracket leg, which first capital bracket legs are inserted or embedded into a capital base annular surface. The first capital bracket legs, when in an assembled state, will preferably lie in substantially vertical planes. Each capital bracket further comprises a second capital bracket leg, which second capital bracket legs preferably lie in planes substantially ninety degrees to the planes in which the first capital bracket legs respectively lay and extend radially inward. The second capital bracket legs each comprise a first slot opening.

Similarly, each column bracket comprises a first column bracket leg, which first column bracket legs are inserted or embedded into a column top annular surface, preferably at equally spaced or substantially equidistant settings of the column top surface. The first column bracket legs, when in an assembled state, will also preferably lie in substantially vertical planes. Each column bracket further comprises a second column bracket leg, which second column bracket legs preferably lie in planes substantially ninety degrees to the planes in which the first column bracket legs respectively lay and extend radially inward. The second column bracket legs each comprise a second slot opening, which second slot openings coincide with the first slot openings of the second capital brackets.

An installation bolt, installation washer and installation nut assembly, fastens each capital bracket/column bracket pairing structure so as to fixedly attach or mount the hollow load-bearing capital to the hollow load-bearing column. In this regard, the installation bolts are inserted through the previously-aligned first slot openings and second slot openings. The installation washers and installation nuts are then attached with each installation bolt to finally join or mount the hollow load-bearing capital to the hollow load-bearing column.

Each hollow load-bearing capital further comprises a capital top annular surface, which capital top annular surface, when in an assembled state, will contact the entranceway ceiling overhang. Each hollow load-bearing capital further comprises a series of capital screw passageways and capital screws for fixedly attaching each hollow load-bearing capital to the entranceway ceiling overhang. Each hollow load-bearing capital is preferably attached to the entranceway ceiling overhang by feeding a capital screw through the capital screw passageways. Each capital screw comprises sufficient length and material to pierce the building structure of the entranceway ceiling overhang and fixedly attach the hollow load-bearing capital to the entranceway ceiling overhang.

Each hollow load-bearing column further comprises an inferior column end portion, which inferior column end portion comprises a load-bearing column floor insert structure and a column bottom annular surface, which column bottom annular surface, when in an assembled state, will contact the entranceway floor. Each hollow load-bearing column further comprises a series of column base holes and locator pins for aligning and inserting each hollow load-bearing column to the entranceway floor. The entranceway floor has a series of entranceway floor holes which correspond in number and spatial location to the base holes of each column structure. The entranceway floor further comprises a series of load-bearing column floor insert-receiving structures. Each hollow load-bearing column may thus be installed by aligning the base holes with locator pins, previously inserted in the floor holes. A crane or similar other equipment may then lower the column structure into place.

The present invention additionally provides a method of assembling a column structure for use with a building structure. The method essentially comprises the steps of pre-forming a tubular column structure and a tubular capital structure from a load-bearing building material; embedding brackets with legs left projecting radially inwardly into the opening defined by the tubular column structure and the tubular capital structure; securing said legs together whereby the capital structure and column structure are connected in unitary relation; and lifting the columns into upright position on a supporting platform of a building structure.

BRIEF DESCRIPTION OF THE DRAWINGS

Other features of the present invention will become more evident from a consideration of the following brief description of the patent drawings, as follows.

DETAILED DESCRIPTION OF THE PREFERRED EMBODIMENT

Figure 1:
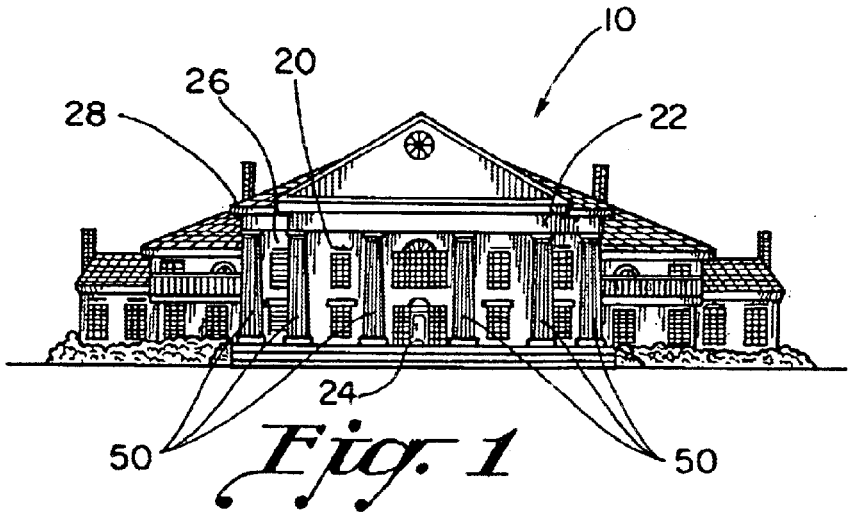
FIG. 1 is a frontal view of a building structure with a series of column structures intermediate an entranceway ceiling overhang and an entranceway floor.
Figure 2:
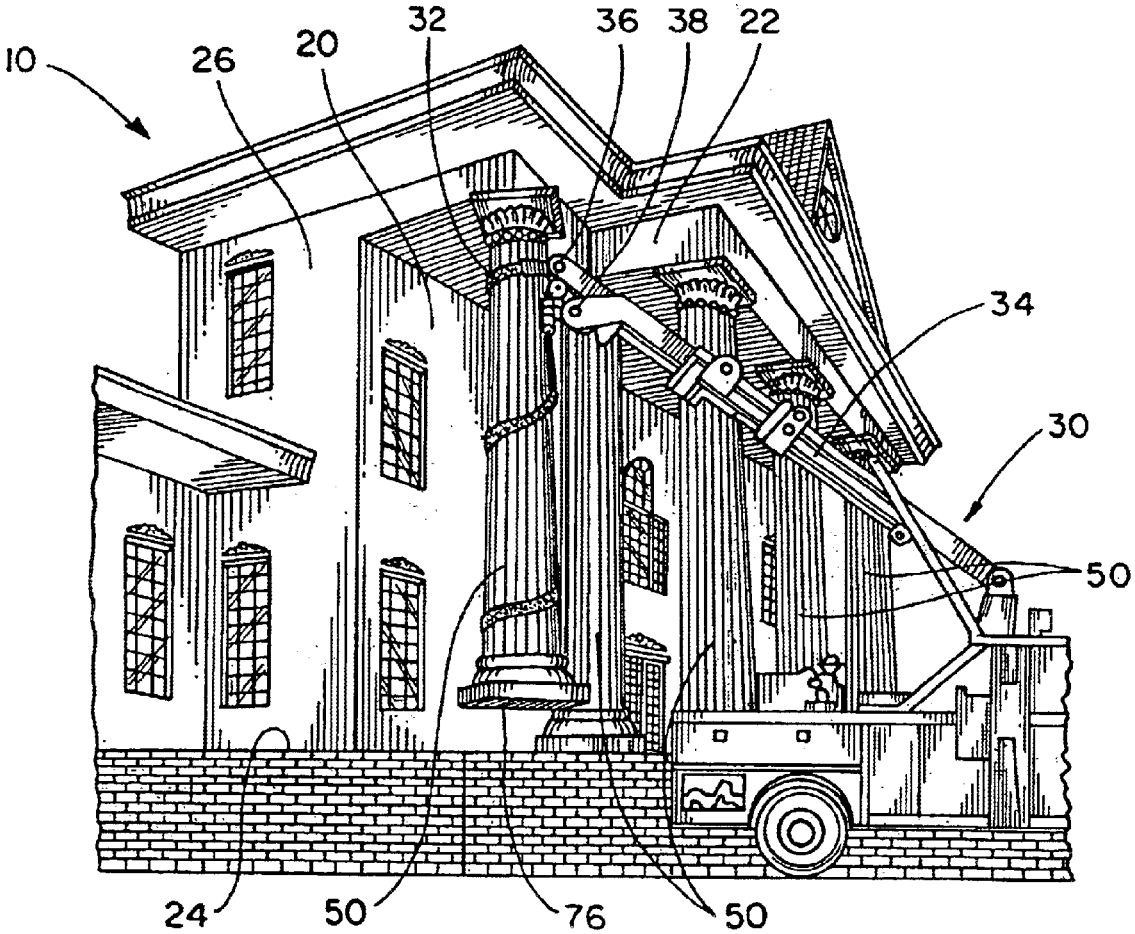
FIG. 2 is a fragmentary perspective view of a building structure with a series of column structures intermediate an entranceway ceiling overhang and an entranceway floor, showing a column structure being installed.

Referring now the drawings, the preferred embodiment of the present invention as assembled and installed is generally illustrated in FIG. 1. The preferred embodiment of the present invention as assembled and ready for installation is generally illustrated in FIG. 2. FIG. 1 shows a building structure 10 as illustrated in FIGS. 1 and 2, with a building entranceway 20 as also illustrated in FIGS. 1 and 2 having an entranceway ceiling overhang 22 and an entranceway floor 24 or a supporting platform of a building structure. Entranceway ceiling overhang 22 and entranceway floor 24 are further illustrated in FIGS. 1, 2 and 4. The entranceway ceiling overhang 22 extends in a forward manner or anteriorly from an enclosed main structure 26 as illustrated in FIG. 2. The enclosed main structure 26 is supported internally whereas the entranceway ceiling overhang 22 is supported by utilizing a series of column structures as generally illustrated. The series of column structures is made up of a number of column structures 50 across the building entranceway 20 to lend support to the entranceway ceiling overhang 22 as illustrated in FIGS. 1 and 2. It is further contemplated that a column structure 50 may be placed in a position close to the enclosed main structure 26 so as to support both the building roof 28 and the entranceway ceiling overhang 22 as generally illustrated in FIG. 1.

FIG. 2 shows the positioning of a column structure 50 into a support position between the entranceway ceiling overhang 22 and the entranceway floor 24. While it is contemplated that a column structure 50 may be hand-installed, it is further preferred that a crane 30 or similar lift system may preferably mechanically hoist or move a column structure 50 via the use of support means or a support strap 32 or other support means such as a rope or cable or the like, and a crane arm 34 as generally illustrated in FIG. 2. Typically, support strap 32 runs from a first point of attachment 36, then spirals downwardly around column structure 50, then spirals around an intermediate portion of column structure 50, then spirals upwardly around column structure 50 to a second point of attachment 38 on crane 30 as illustrated in FIG. 2.

Each column structure 50 comprises a hollow load-bearing capital 80 as illustrated in FIGS. 3–5 and 7, which hollow load-bearing capital 80 is mounted on top of a hollow load-bearing column 70 as illustrated in FIGS. 3–5 and 8. Both hollow load-bearing capital 80 and hollow load-bearing column 70 comprise or are constructed from load-bearing building materials or preferably, polystone. As earlier indicated, the state of materials art is such that polyester resins when mixed with ground limestone in a ratio of approximately 25% resin to 75% limestone creates a material suitable for construction of a hollow load-bearing column 70 and a hollow load-bearing capital 80. Such materials in use are referred to as "polystone." Polystone columns have a far greater load-bearing capacity than wooden posts and have a longer life span than wooden posts. A hollow load-bearing column 70 with a hollow load-bearing capital 80 constructed from polystone has a load-bearing capacity of up to 20,000 pounds with a safety factor of 10. It is further contemplated that hollow load-bearing capital 80 and hollow load-bearing column 70 may comprise or be constructed from concrete, but polystone is the preferred building material insofar as polystone has a much faster cure rate of the order of 15–20 minutes as compared to hours or days for concrete.

Figure 4:
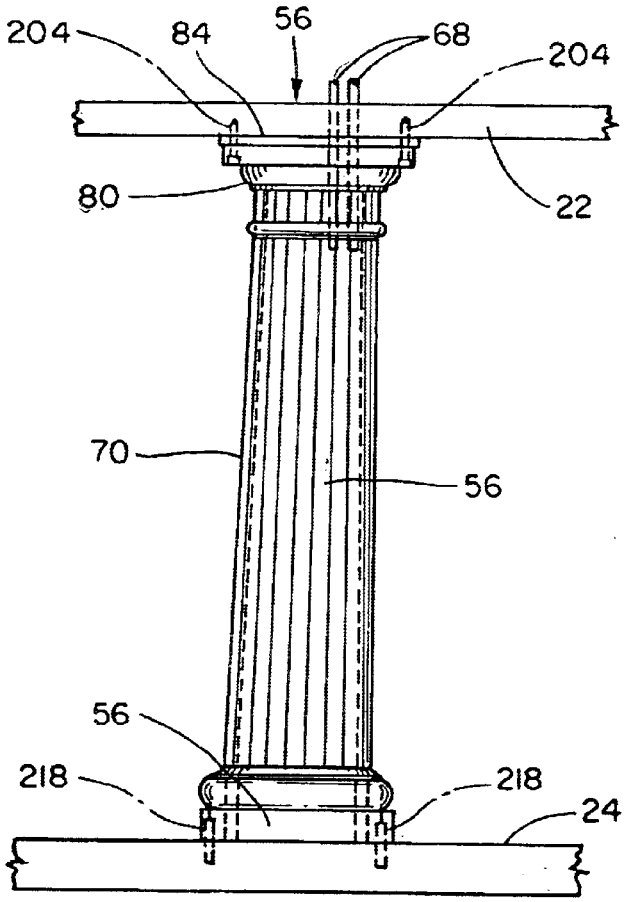
FIG. 4 is a fragmentary frontal view of a column structure intermediate an entranceway ceiling overhang and an entranceway floor of a building structure.
Figure 5:
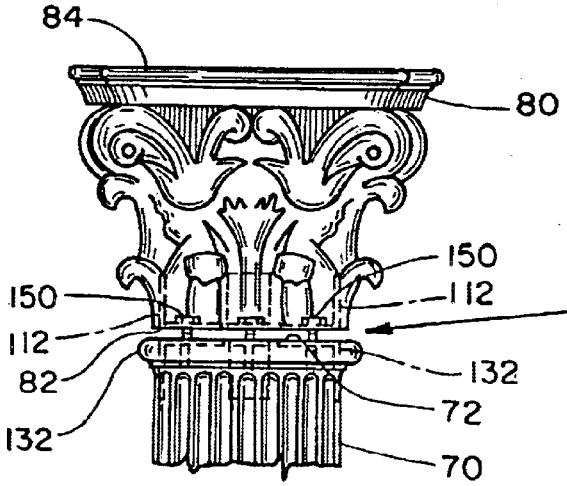
FIG. 5 is a fragmentary frontal view of a hollow load-bearing capital being attached to a hollow load-bearing column, showing the hollow load-bearing capital and hollow load-bearing column in stacked relation.
Figure 6:
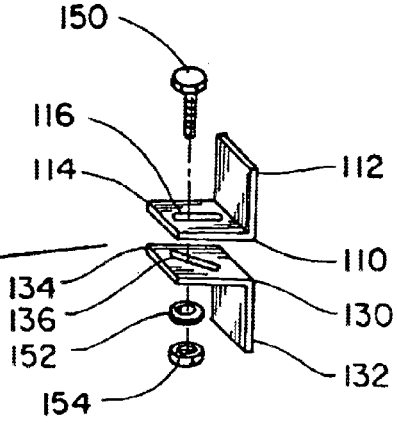
FIG. 6 is an exploded view of a capital bracket/column bracket pairing with installation bolt, installation washer and installation nut assembly.
Figure 7:
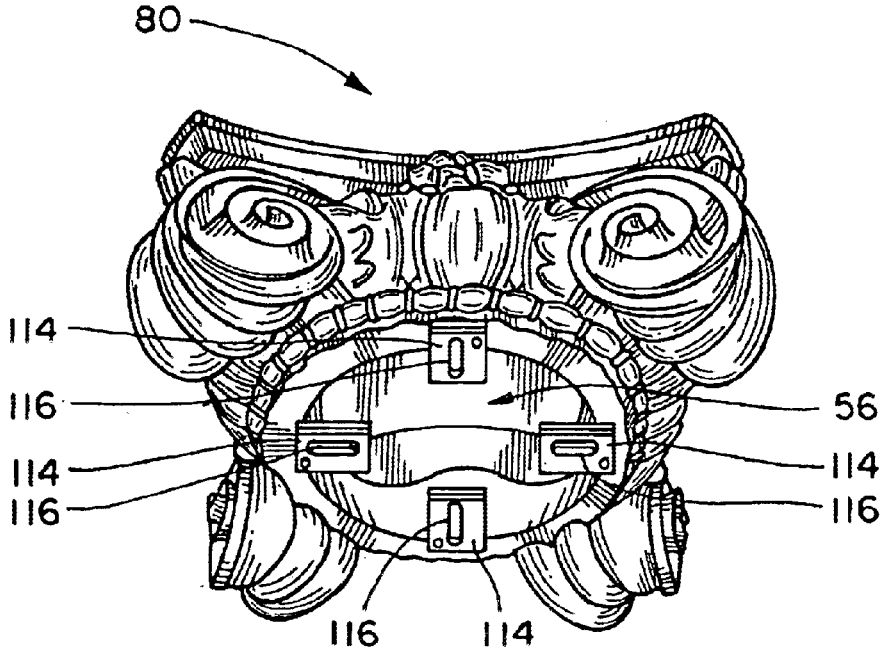
FIG. 7 is a bottom perspective view of the hollow load-bearing capital in FIG. 5 showing a capital base annular surface with embedded capital brackets.
Figure 8:
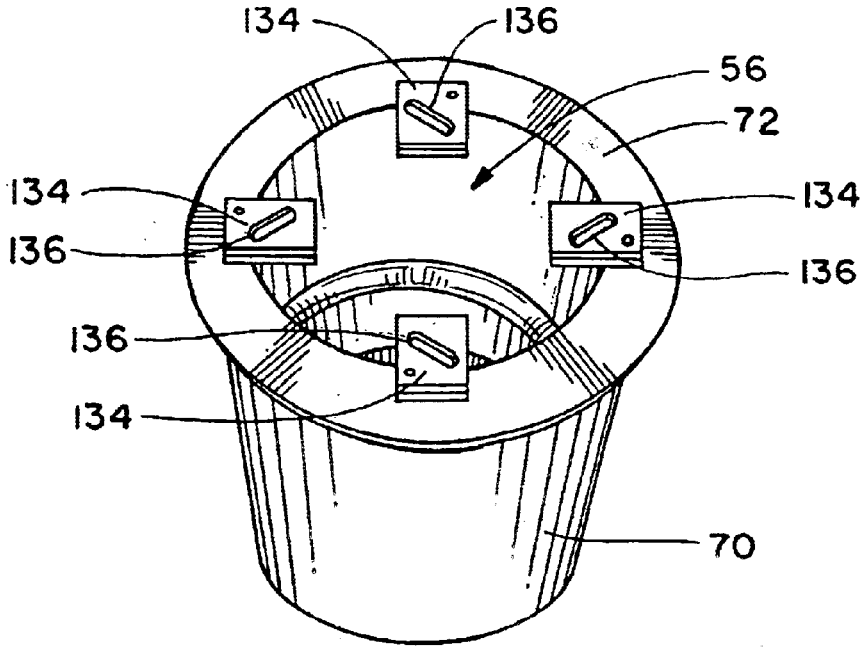
FIG. 8 is a top perspective view of the hollow load-bearing column in FIG. 5 showing the column top annular surface with embedded column brackets.

Hollow load-bearing column 70 and hollow load-bearing capital 80 together define a passageway 56 illustrated in FIGS. 4, 7 and 8, which passageway 56 may be used for concealing conduit 68 as diagrammatically illustrated in FIG. 4. It is contemplated, for example that hollow load-bearing column 70 and hollow load-bearing capital 80 together define passageway 56 that may be used for concealing utility conduit, namely, electrical conduit, water piping or other similar plumbing structure, gas lines, or communications cable and the like. Column structure 50 further comprises means for attaching or mounting hollow load-bearing capital 80 to hollow load-bearing column 70. Preferably, the means for attaching or mounting hollow load-bearing capital 80 to hollow load-bearing column 70 comprises a series of sets of brackets as generally illustrated in FIGS. 5–8, which sets of brackets are preferably placed in substantially uniformly spaced distance around a circumference of contact between hollow load-bearing capital 80 and hollow load-bearing column 70. The electrical conduit can run the full length of the column.

The brackets are preferably paired off or comprise a plurality of capital bracket/column bracket pairing as generally illustrated in FIG. 6. Preferably, the capital bracket/column bracket pairings are at least four in number. As will be seen from an inspection of FIG. 6, each capital bracket/column bracket pairing preferably comprises a capital bracket 110 and a column bracket 130. Each capital bracket 110 comprises a first capital bracket leg 112 as illustrated in FIGS. 5–7, which first capital bracket legs 112 are inserted or embedded into a capital base annular surface 82, preferably at equally-spaced or substantially equidistant settings of hollow load-bearing capital 80 as is generally illustrated in FIGS. 5 and 7. First capital bracket legs 112, when in an assembled state, will preferably lie in substantially vertical planes as generally illustrated in FIG. 5. Each capital bracket 110 further comprises a second capital bracket leg 114 as illustrated in FIGS. 6 and 7, which second capital bracket legs 114 preferably lie in planes substantially ninety degrees to the planes in which first capital bracket legs 112 respectively lay as further illustrated in FIGS. 6 and 7. Second capital bracket legs 114 each further comprise fastening means receiving structure or preferably a first slot opening 116 as further illustrated in FIGS. 6 and 7.

Each column bracket 130 comprises a first column bracket leg 132 as illustrated in FIGS. 5, 6 and 8, which column bracket legs 132 are inserted or embedded into a column top annular surface 72, preferably at equally spaced or substantially equidistant settings of hollow load-bearing column 70 as illustrated in FIGS. 5 and 8. Column bracket legs 132, when in an assembled state, will also preferably lie in substantially vertical planes as illustrated in FIG. 5. Each column bracket 110 further comprises a second column bracket leg 134, which second column bracket legs 134 preferably lie in planes substantially ninety degrees to the planes in which column bracket legs 132 respectively lay as further illustrated in FIGS. 6 and 8. Second column bracket legs 134 each comprise fastening means receiving structure or preferably a second slot opening 136 as further illustrated in FIGS. 6 and 8. Second slot opening 136 is preferably an angular slot angled across said second leg as further generally illustrated in FIGS. 6 and 8.

Both series of second bracket legs 114 and 134 extend radially inward or toward the centers of each hollow load-bearing column 70 and hollow load-bearing capital 80 as generally illustrated in FIGS. 7 and 8. Fastening means or, preferably, an installation bolt, installation washer and installation nut assembly, fasten each capital bracket/column bracket pairing structure so as to fixedly attach or mount hollow load-bearing capital 80 to hollow load-bearing column 70. In this regard, installation bolts 150 are inserted through previously aligned first slot openings 116 and second slot openings 136. Installation washers 152 and installation nuts 154 are then attached with each installation bolt 150 as generally illustrated in FIG. 6 to join or mount hollow load-bearing capital 80 to hollow load-bearing column 70 as generally illustrated in FIG. 5.

Figure 3:
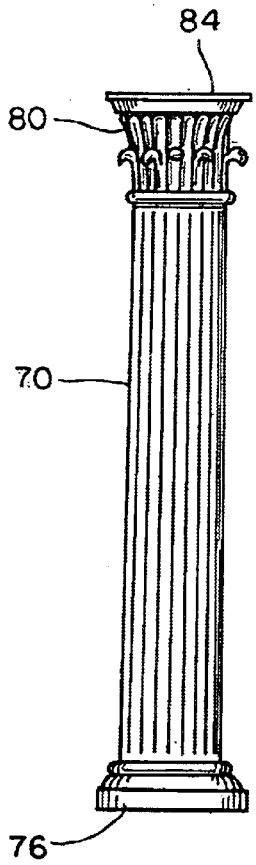
FIG. 3 is a frontal view of a column structure.

Each hollow load-bearing capital 80 further comprises a capital top annular surface 84 as illustrated in FIGS. 3–5, which capital top annular surface 84, when in an assembled state, will contact entranceway ceiling overhang 22 as generally illustrated in FIG. 4. Each hollow load-bearing capital 80 further comprises means for attaching hollow load-bearing capital 80 to entranceway ceiling overhang 22. Preferably, the means for attaching hollow load-bearing capital 80 to entranceway ceiling overhang 22 comprises a series of capital screw passageways and capital screws for fixedly attaching each hollow load-bearing capital 80 to entranceway ceiling overhang 22. Each hollow load-bearing capital 80 is preferably attached to entranceway ceiling overhang 22 by feeding a capital screw 204 through the capital screw passageways. Each capital screw 204 is of sufficient length to pierce the building structure of entranceway ceiling overhang 22 and fixedly attach hollow load-bearing capital 80 to entranceway ceiling overhang 22 as generally illustrated in FIG. 4. Preferably, general construction adhesive is applied to capital top annular surface 84 before hollow load-bearing capitals 80 are fixedly attached to entranceway ceiling overhang 22.

Each hollow load-bearing column 70 further comprises an inferior column end portion, which inferior column end portion comprises a column bottom annular surface 76 as illustrated in FIGS. 2 and 3, which column bottom annular surface 76, when in an assembled state, will contact entranceway floor 24. Each hollow load-bearing column 70 further comprises means for attaching hollow load-bearing column 70 to entranceway floor 24. Preferably, the means for attaching hollow load-bearing column 70 to entranceway floor 24 comprises a series of column base holes and locator pins 218 for aligning and inserting each hollow load-bearing column 70 to entranceway floor 24 as generally illustrated in FIG. 4. Entranceway floor 24 has entranceway floor holes which correspond in number and spatial location to the base holes. Preferably, epoxy glue is placed into the floor holes prior to the insertion of locator pins 218. Locator pins 218 are thus placed into the epoxy-impregnated entranceway floor holes.

Hollow load-bearing column 70 may thus be installed by aligning the base holes with the locator pins 218 and then crane 30 may lower hollow load-bearing column 70 into place as generally illustrated in FIG. 2. The superior ends of locator pins 218 are thus received in the base holes. Preferably, general construction adhesive is applied to column bottom annular surface 76 before hollow load-bearing columns 70 are placed upon entranceway floor 24.

The present invention thus additionally provides a method of assembling a column structure for use in combination with a building structure. The method essentially comprises the steps of (1) pre-forming a tubular column structure and a tubular capital structure from a load-bearing building material with internal passageways extending from end to end in the tubular column structure and the tubular capital structure; (2) embedding brackets in the passageways with bracket legs projecting radially inwardly into the passageways in the tubular column structure and the tubular capital structure; (3) securing said bracket legs in the passageway of the tubular column structure to the bracket legs in the tubular capital structure connecting the tubular column structure to the tubular capital structure, the tubular column structure and the tubular capital structure thus being connected in unitary relation with the passageways being in axial alignment; and (4) lifting the unitized tubular column structure and the tubular capital structure into upright position on a supporting platform of a building structure.

It is further contemplated that the present invention further provides a method of assembling a column structure for use in combination with a building structure, the method comprising the steps of (1) forming a tubular column structure and a tubular capital structure from a load-bearing building material with internal axially-extending passageways extending from end to end in the tubular column structure and the tubular capital structure while contemporaneously embedding brackets in the axially-extending passageways with bracket legs projecting radially inwardly into an interior open area of the axially-extending passageways in the tubular column structure and the tubular capital structure during a formation process of column and capital structure; and (2) securing said bracket legs in the axially-extending passageway of the tubular column structure to the bracket legs in the tubular capital structure connecting the tubular column structure to the tubular capital structure in unitary assembly with the passageways being in axial alignment.

It is further contemplated that the described method further includes the step of lifting the unitized tubular column structure and the tubular capital structure into an upright ground supported position beneath the canopy, installing conduits in said columnar passageways, and then installing a canopy over the unitized columnar structures with the tubular column structure and the tubular capital structure supporting the canopy in load-bearing relation. The method of may comprise unitized column structures provide a means of support leaving said tubular passageways open with the utility lines installed therein. Further, the described method may include the step of building a canopy over the column structures in mounted supported assembly on the column structures after the column structures have been installed in an assembled upright position in the building structure. Further still, the described method may include the step of molding the brackets with the capital and column structures simultaneously so that the brackets for the capital structures and the brackets for the column structures are placed in proper positions for attachment of the column and capital structures in a unitary assembly.

While the above descriptions contain much specificity, the specificity should not be construed as limitations on the scope of the invention, but rather as an exemplification of the invention. Accordingly, although the invention has been described by reference to a preferred embodiment and an alternative embodiment, it is not intended that the novel device be limited thereby, but that modifications thereof are intended to be included as falling within the broad scope and spirit of the foregoing disclosure, the following claims and the appended drawings.

I claim:

1. A column structure for a building entranceway, the column structure comprising:

a hollow load-bearing capital, the hollow load-bearing capital being mounted on top of a hollow load-bearing column, the hollow load-bearing column and the hollow load-bearing capital defining an upright passageway, the upright passageway for concealing conduit;

attachment means joining the hollow load-bearing column to the hollow load-bearing capital in unitary assembly, the attachment means comprising a series of bracket pairs, the bracket pairs being placed in substantially uniform distances around a circumference of contact between the hollow load-bearing capital and the hollow load-bearing column, the bracket pairs each having a capital bracket portion and a column bracket portion, the capital bracket portions each having a first capital bracket leg and a second capital bracket leg, the first capital bracket legs each being embedded in a side wall of the hollow load-bearing capital, the second capital bracket legs each extending radially inwardly into the upright passageway, the capital bracket second legs each having a capital fastener slot, the column bracket portions each having a first column bracket leg and a second column bracket leg, the first column bracket legs being embedded in a side wall of the hollow load-bearing column, the second column bracket legs each extending radially inwardly into the upright passageway, the column bracket second legs each having a column fastener slot, the capital fastener slots being in superimposed, paired axial alignment with the column fastener slots for joining the bracket pairs in fixed assembly; and fastening means extending through the capital fastener slots and the column fastener slots, the fastening means thus joining the bracket pairs in fixed assembly.

2. The attachment means of claim 1 wherein the series of bracket pairs comprises at least four bracket pairs, the four bracket pairs being mounted in substantially equidistant relation about the circumference of contact between the hollow load-bearing capital and the hallow load-bearing column.

3. The attachment means of claim 1 wherein the fastening means comprises a series of bolts extending through the column fastener slots and the capital fastener slots, a washer placed upon each bolt flush against the alignment of column fastener slots and capital fastener slots, and a nut securely attached to each bolt.

4. The column structure of claim 1 wherein the load-bearing capital and the load-bearing column are constructed from polystone.

5. A column structure for a building entranceway, the column structure comprising:

a hollow load-bearing capital, the hollow load-bearing capital being mounted on top of a hollow load-bearing column, the hollow load-bearing column and the hollow load-bearing capital defining an upright passageway, the upright passageway for concealing conduit;

attachment means joining the hollow load-bearing column to the hollow load-bearing capital in unitary assembly, the attachment means comprising a series of bracket pairs, the bracket pairs being attached to the load-bearing capital and to the load-bearing column, each of the bracket pairs comprising first bracket portions and second bracket portions, the first bracket portions being fixedly attached to the upright passageway, the second bracket portions extending radially inwardly of the upright passageway, the second bracket portions being secured together to secure the load-bearing capital to the load-bearing column.

6. The attachment means of claim 5 wherein the series of bracket pairs comprises at least four bracket pairs, the four bracket pairs being mounted in substantially equidistant relation about the circumference of contact between the load-bearing capital and the load-bearing column.

7. The column structure of claim 5 wherein the load-bearing capital and the load-bearing column comprise polystone.

8. In a building structure including column structures comprising:

a. a hollow load-bearing column;

b. a hollow load-bearing capital mounted on top of the hallow load-bearing column, the hollow column and the hollow capital defining a vertically-extending columnar utility pipe passageway for concealing utility conduit;

c. attachment means for joining each of the columns to an associated one of the capitals, the attachment means comprising a series of paired brackets, the paired brackets each having a first bracket portion and a second bracket portion, the first bracket portions each being embedded in either the column or the capital, the second bracket portions each extending radially inwardly into the vertically-extending columnar utility pipe passageway, the second portions of the brackets being in superimposed, paired, axial alignment; and d. fasteners joining each of the second portions in each of the paired brackets in fixed assembly to secure each of the capitals in unitary assembly to an associated one of the columns leaving the vertically-extending columnar utility pipe passageways open for location of utility conduit.

9. The building structure of claim 8 wherein the first bracket portions are each defined by a first leg and the second bracket portions are each defined by a second leg, the first legs and the second legs being disposed at substantially right angles to one another.

10. The building structure of claim 9 wherein the first legs and the second legs each have a substantially uniform length and width.

11. The building structure of claim 9 wherein said second legs each have an angular slot angled thereacross.

12. The building structure of claim 8 wherein said paired brackets are positioned 90 degrees apart around a circumference of said vertically-extending columnar utility pipe passageway.

13. A building structure including column structures for building entranceways, said column structures comprising:

a. upright hollow load-bearing columns spaced apart along a building wall;

b. hollow load-bearing capitals mounted on top of the hollow load-bearing columns, each hollow column and each hollow capital defining an upright columnar passageway for concealing conduit;

c. attachment means located inside of each of the upright columnar passageways joining each of the hollow load-bearing columns to an associated one of the hollow load-bearing capitals, the attachment means comprising a series of brackets, the brackets having bracket pairing, the brackets each having a first bracket portion and a second bracket portion, the first bracket portions being embedded in side walls of the hollow load-bearing columns and the hollow load-bearing capitals, the second bracket portions extending radially inward into the columnar passageway, the second bracket portions having axially aligned fastener slots; and d. fasteners extending through said fastener slots joining each of the second bracket portions in each bracket pairing in fixed assembly to secure each of the hollow load-bearing capitals in unitary assembly to an associated one of the hollow load-bearing columns leaving each of the columnar passageways open and unobstructed for location of conduit.

14. The building structure of claim 13 further defined by conduit located in at least one of said columnar passageways for harboring electrical and/or plumbing lines therein.

15. In a building structure including improved column structures for building entranceways, the improvement of each of the column structures comprising:

a hollow load-bearing column;

a hollow load-bearing capital mounted on top of the hollow load-bearing column, the hollow column and the hollow capital defining a columnar passageway;

attachment means for joining each of the columns to an associated one of the capitals, the attachment means comprising a series of sets of brackets, the sets of brackets each having a first bracket portion embedded in either the column or the capital and a second bracket portion extending radially inwardly into the columnar passageway, the second bracket portions being in superimposed, paired, axial alignment; and fasteners joining each of the second bracket portions in each of the pairs in fixed assembly to secure each of the capitals in unitary assembly to an associated one of the columns.

16. The building structure of claim 15 wherein the first bracket portions are each defined by a first leg and the second bracket portions are each defined by a second leg, the first legs and the second legs disposed at substantially right angles to one another.

17. The building structure of claim 16 wherein the first legs and the second legs each have a substantially uniform length and width.

18. The building structure of claim 16 wherein said second legs each comprise an angular slot.

19. The building structure of claim 15 wherein said superimposed sets of brackets are positioned 90 degrees apart around a circumference of said passageway.

20. A method of assembling a column structure for use in combination with a building structure, the method comprising the steps of:

a. pre-forming a tubular column structure and a tubular capital structure from a load-bearing building material with internal passageways extending from end to end in the tubular column structure and the tubular capital structure;

b. embedding brackets in the passageways with bracket legs projecting radially inwardly into the passageways in the tubular column structure and the tubular capital structure;

c. securing said bracket legs in the passageway of the tubular column structure to the bracket legs in the tubular capital structure connecting the tubular column structure to the tubular capital structure, the tubular column structure and the tubular capital structure thus being connected in unitary relation with the passageways being in axial alignment; and d. lifting the unitized tubular column structure and the tubular capital structure into upright position on a supporting platform of a building structure.

21. A method of assembling a column structure for use in combination with a building structure, the method comprising the steps of:

a. forming a tubular column structure and a tubular capital structure from a load-bearing building material with internal axially-extending passageways extending from end to end in the tubular column structure and the tubular capital structure while contemporaneously embedding brackets in the axially-extending passageways with bracket legs projecting radially inwardly into an interior open area of the axially-extending passageways in the tubular column structure and the tubular capital structure during a formation process of column and capital structure;

b. securing said bracket legs in the axially-extending passageway of the tubular column structure to the bracket legs in the tubular capital structure connecting the tubular column structure to the tubular capital structure in unitary assembly with the passageways being in axial alignment.

22. The method of claim 21 further including the step of lifting the unitized tubular column structure and the tubular capital structure into an upright ground supported position beneath the canopy, installing conduits in said columnar passageways, and then installing a canopy over the unitized columnar structures with the tubular column structure and the tubular capital structure supporting the canopy in load-bearing relation.

23. The method of claim 22 wherein the unitized column structures provide a means of support leaving said tubular passageways open with the utility lines installed therein.

24. The method of claim 21 including the step of building a canopy aver the column structures in mounted supported assembly on the column structures after the column structures have been installed in an assembled upright position in the building structure.

25. The method of claim 21 including the step of integrally molding the brackets with the capital and column structures simultaneously so that the brackets for the capital structures and the brackets for the column structures are placed in proper positions to facilitate attachment of the column structure and capital structure in unitary assembly together.

26. A column structure for a building entranceway, the column structure comprising:

a hollow load-bearing capital, the hollow load-bearing capital being mounted on top of a hollow load-bearing column, the hollow load-bearing column and the hallow load-bearing capital defining an upright passageway, the upright passageway for concealing conduit;

a series of bracket pairs, the bracket pairs being spaced in substantially uniform distances around a circumference of contact between the hollow load-bearing capital and the hollow load-bearing column, the bracket pairs each having a capital bracket portion and a column bracket portion, the capital bracket portions each having a first capital bracket leg and a second capital bracket leg, the second capital bracket legs each being at substantially ninety degree angle with respect to the first capital bracket legs, the first capital bracket legs each being inserted into a capital base annular surface, the second capital bracket legs each having a first slot opening, the column bracket portion each having a first column bracket leg and a second column bracket leg, the second column bracket legs being at substantially ninety degree angle with respect to the first column bracket legs, the first column bracket legs each being inserted into a column top annular surface, the second column bracket legs each having a second slot opening; and fastening means for fastening the capital bracket portion to the column bracket portion, the fastening means extending through an alignment of the first slot opening and the second slot opening.

27. The column structure of claim 26, wherein the fastening means comprises a series of bolts extending through the alignment of the first slot opening and the second slot opening, a washer placed upon each bolt flush against the alignment of the slot openings, and a nut securely attached to each bolt flush against each washer.

* * * * *